United States Patent [19]

Lin

[11] Patent Number: 4,751,625

[45] Date of Patent: Jun. 14, 1988

[54] BODY-ELECTROSTATIC INDUCTION TYPE OF LAMP DEVICE

[76] Inventor: John Y. Lin, No. 12, Lane 179, Lee Sing Road Sec. 1, San Chung City, Taipei, Taiwan

[21] Appl. No.: 66,515

[22] Filed: Jun. 26, 1987

[51] Int. Cl.[4] ..... F21V 00/00

[52] U.S. Cl. ..... 362/276; 362/352; 362/802; 362/395

[58] Field of Search ..... 362/352, 395, 276, 802

[56] References Cited

U.S. PATENT DOCUMENTS

| | | | |
|---|---|---|---|
| 2,632,098 | 3/1953 | Marchese | 362/395 |
| 2,810,066 | 10/1957 | Green | 362/395 |
| 4,625,268 | 11/1986 | Payne | 362/352 |

*Primary Examiner*—E. Rollins Cross

[57] ABSTRACT

It is a body-electrostatic induction type of lamp device, in which the parts include the lamp shade and the lamp stand with an electrical circuit; when a person's body touches one of the aforesaid parts, the lamp can be lighted up or turned off.

4 Claims, 3 Drawing Sheets

BODY-ELECTROSTATIC INDUCTION TYPE OF LAMP DEVICE

BACKGROUND OF THE INVENTION

In the conventional metal-touch lamp, the user has to touch the metal surface. Since metal is a conductive material, the static charge of a person's body can be transmitted into the touch switch; however, the color of metals has less variation such as gold, copper, or silver white. If the parts of a lamp can use materials other metal, the colors of the lamps would have a large range of variety; for instance, the ceramic lamp stand can be made into many colors such as red, blue, white, yellow, black, purple, green, etc.; further, the lamp stand can also be made into many shapes with different patterns. In addition to ceramic material, the lamp stand can also be made of wood, stone, etc. so as to match the color of other furnitures in a room such as the wall color, sofa, desk, bed, etc.; therefore, the inventor has developed the present invention, i.e., a body-electrostatic induction type of lamp device with a non-metal lamp stand and non-metal lamp shade so as to break through the drawbacks of the aforesaid limit of the conventional lamp. According to the present invention, the inner wall of the hollow lamp stand is coated with a conductive film; upon the lamp being turned on, the lamp stand surface acts as one conducting plate of a capacitor. Upon the lamp stand being contacted by a person, a static charge will be generated on the non-metal surface of the lamp stand, and it will be transmitted and coupled to the touch switch to fulfill the function of a non-metal lamp providing an electrostatic charge. The lamp made by means of the aforesaid new method can use many kinds of non-metal materials. The lamp shade according to the present invention is foldable so as to reduce storage dimensions and to save shipping fare. In order to reduce the packing dimensions of the lamp, the outer shade can be removed from the frame for washing or replacing one with different color so as to increase the user's interest; therefore, it is deemed a practical and economical disclosure. In fact, this invention is an improvement of my application No. 06,795,178 filed Nov. 5, 1986.

SUMMARY OF THE INVENTION

This invention relates to an improved table lamp, which comprises a non-metal lamp shade and lamp stand, a common touch switch, a plug, an electric wire, a lamp socket, a bulb, and a plurality of metal parts. The nonmetal portions in the lamp shade and the lamp stand have the same after being processed with the method according to the present invention.

The lamp stand of the present invention is made of clay, porcelain, ceramic, wood, plaster, stone or plastic material. The inner portion of the lamp stand is made into a hollow space; the inner wall of that hollow lamp stand is coated with a conductive film, which forms a conducting plate of a capacitor by means of the insulating wall of the lamp stand. Upon a person contacting the non-metal surface of the lamp stand, a static charge will be generated on the conductive film to form a signal, which will soon be coupled, through other conductive parts, to the touch swith. Since each of the metal parts is conductive, the static charge caused by a person's body can be transmitted, via a metal fiber net on the surface of the lamp shade and the metal parts, to the touch switch immediately; in other words, both the lamp shade and the lamp stand can have a body induction effect.

The surface of the lamp shade is covered with a metal fiber net to be sewed or adhered to a non-metal material surface such as cloth; the metal fiber net is fastened, by means of metal screws through the non-metal shade, to the metal frame of the lamp shade. Upon the lamp shade being touched by a person, the static charge of the person's body will pass through the metal fiber net, the metal screws, the metal frame, and the metal tube in the lamp stand to the touch switch so as to generate a body induction effect.

To assemble the lamp shade, first insert the three reverse L-shaped frames into the ring fixture respectively; then, mount three T-shaped connectors and three reverse Tshaped connectors to the both ends of the reverse L-shaped frames respectively. The three T-shaped connectors on the upper ends of the reverse L-shaped frames are mounted with three arc-shaped wires respectively to form into the upper ring; then, mount the outer shade over the upper ring; the lower edge of the outer shade has three bags for putting three arc-shaped wires respectively, and then the arcshaped wires are inserted into three reverse T-shaped connectors respectively to form the lower ring. The upper edge of the outer shade is sewed with an elastic cord for controlling the outer shade to be mounted over the shade frame at a suitable tension. According to the aforesaid procedures, the lamp shade can be assembled or disassembled by the user so as to provide more pleasure to the user. The outer shade can be folded up into a small piece to be packed together with the disassembled lamp shade frame, being packed into the container of the lamp stand for the convenience of shipping and saving shipping fare; therefore, the present invention is deemed a new, interesting and practical disclosure.

DETAILED DESCRIPTION

Figure 1A:
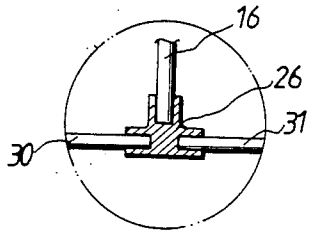
FIG. 1A is an enlarged view of the reverse T-shaped connector of the present invention.
Figure 1:
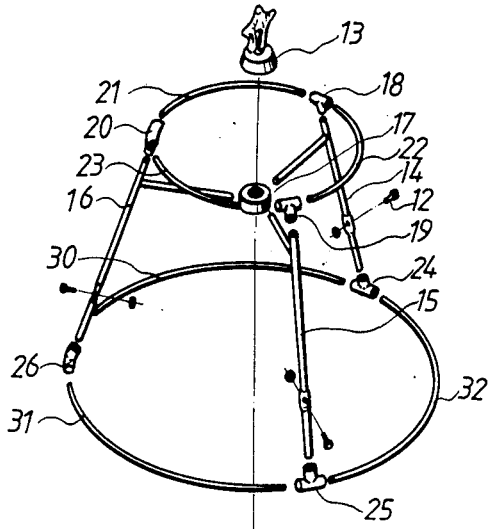
FIG. 1 is a disassembled view of the embodiment of a lamp according to the present invention.
Figure 1:
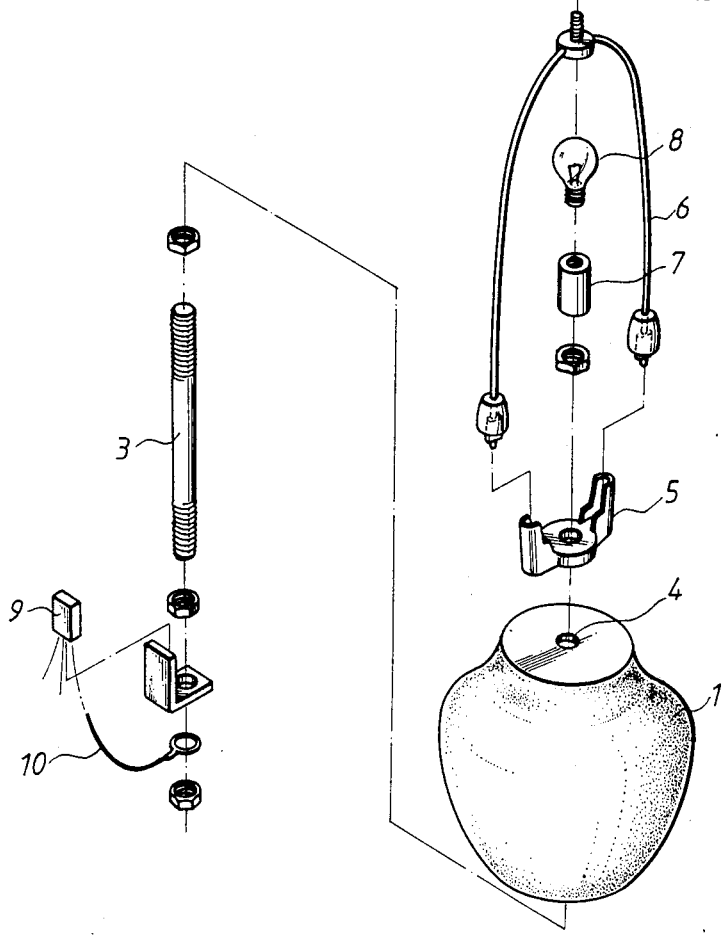

As shown in FIG. 1, the present invention is an improved table lamp, which mainly comprises an improved lamp shade, a common switch 9, a lamp stand 1, a metal support frame 6, three reverse L-shaped frame members 14, 15, and 16, conductive wires, a plug, a lamp socket 7, and a lamp 8. The lamp stand 1 is made of non-metal material (such as clay, ceramic, wood, plaster, stone or plastics, etc.), and is formed into a hollow jar-shaped body, of which the inner surface is coated with a thin layer of conductive metal liquid. After the coated liquid being dried, a conductive film 2 is formed; that conductive film becomes an important member to transmit the static charge of human body. A hollow metal tube 3 is mounted through a hole 4 on the top of the lamp stand 1, and the tube 3 is fixed in place with a metal fixture 5 and two nuts. The metal fixture 5 is used for mounting a metal support frame 6 in a detachable manner; the lamp socket 7 is to be fixedly mounted on the hollow metal tube 3 above the metal fixture 5; then, a lamp 8 is mounted on the socket 7.

The conductive film 2 and the metal fixture 5 are fastened on the non-metal lamp stand 1 by means of the hollow metal tube 3 and a metal nut; since the conductive film 2, the hollow metal tube 3 and the nut are conductive parts, a conductive circuit is to be formed upon the sensor wire 10 of the touch switch 9 being fastened, by means of a metal nut, on the threaded portion of the hollow metal tube 3. Upon the table lamp being electrically connected with a power supply, and upon a human body contacting the non-metal lamp stand 1, there will be a capacitor effect 11 existing thereon; i.e., a static charge existing between the human body and the conductive film 2 isolated with a non-metal material. That static charge would pass through the metal nut, the metal tube 3, and the sensor wire 10 of the touch switch 9, etc. to be coupled into the touch switch 9, which has several control steps to control the A.C. (alternating current) power to pass through the wire in the metal tube 3, the lamp socket 7 and finally to the bulb 8, which can be lighted up or turned off. The aforesaid structure system is deemed a new disclosure to solve the problem of a non-metal lamp stand unable to conduct electricity. By means of the present invention, many kinds of lamp stands can generate a capacitive effect. Moreover, since the metal support frame 6 is mounted on the metal fixture 5, the frame also can transmit the static charge of human body to the metal frame of the lamp shade; then, the static charge can be, by means of three small metal screws 12, transmitted to the conductive fiber net 28 on the furface of the non-metal lamp shade. The conductive fiber net 28 is made of a metal filaments and fine cotton threads, and it is conductive to the static charge of human body; therefore, when a person's body contacting the surface of the lamp shade, the static charge of the body would be transmitted through the shade surface, the metal screws 12, the metal frame of the lamp shade, the metal support frame 6, the nut 13, the metal tube 3, and the sensor wire 10, etc.; finally, the static charge is coupled into the touch switch 9.

In order to let the lamp shade save space and expenses upon being shipped, the metal frame of the lamp shade and the outer shade 27 are made in a detachable manner. First, insert three resembling reverse L-shaped frames 14, 15 and 16 into the three holes of a ring fixture 17 respectively, and then mount three T-shaped connectors 18, 19 and 20 over the upper ends of the reverse L-shaped frames 14, 15 and 16 respectively so as to have three arc-shaped wires 21, 22 and 23 inserted into the end holes of the T-shaped connectors 18, 19 and 20 respectively to form into an upper ring (as shown in FIG. 1A, which is an enlarged view of the reverse T-shaped connector 26).

Then, the reverse T-shaped connectors 24, 25 and 26 are mounted to the lower ends of the reverse L-shaped frames 14, 15 and 16 respectively so as to form a lower ring with three arc-shaped wires 30, 31 and 32. The upper end of the outer shade 27 is mounted with an elastic cord 29 by sewing a folded portion of the upper edge of the outer shade 27. The elasticity of the elastic cord can just have the outer shade evenly mounted over the frame. The lower edge of the outer shade 27 is also sewed up to form into three sleeves so as to mount three arc-shaped wires 30, 31 and 32 into the sleeves respectively. Among the three sleeves, there are three openings 33, 34 and 35 formed at the same distance one from another along the lower edge of the outer shade; after the outer shade 27 being opened with hands to mount over the lamp shade frame, three arc-shaped wires 30, 31 and 32 are inserted into the sleeves from the three openings 33, 34 and 35 respectively; then, the three arc-shaped wires 30, 31 and 32 are inserted into three reverse T-shaped connectors 24, 25 and 26 respectively to form a lower ring. Since the lower ring is fixedly mounted on the frame of lamp shade, and since the upper and lower rings are supporting the outer shade 27, the outer shade 27 can be mounted over the frame evenly by means of the elastic cord 29; then, a hollow lamp shade is formed. In case of replacing or washing the outer shade 27, disassemble the three arc-shaped wires 30, 31 and 32 of the lower ring; the outer shade 27 can be removed easily.

Figure 2:
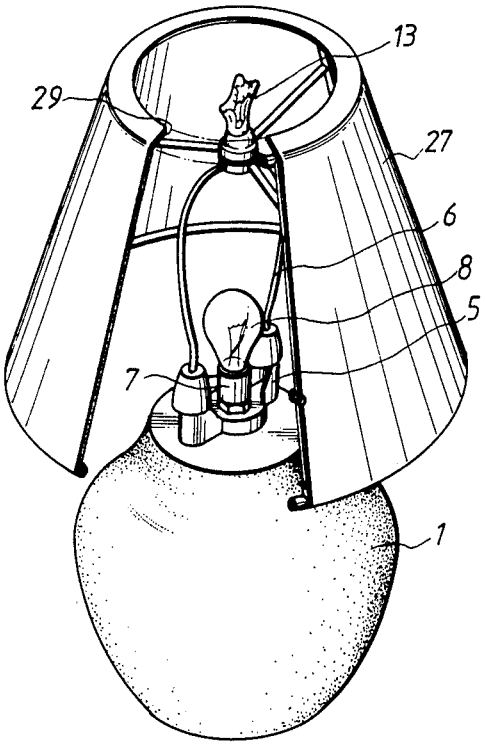
FIG. 2 is an assembled view of the present invention with a fragmental sectional view on the lamp shade.
Figure 2A:
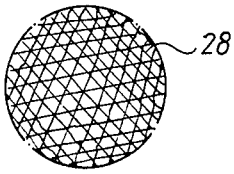
FIG. 2A is a perspective view of the outer shade according to the present invention.
Figure 2B:
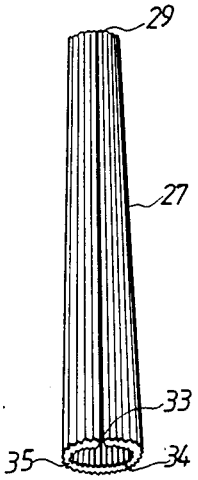
Figure 3:
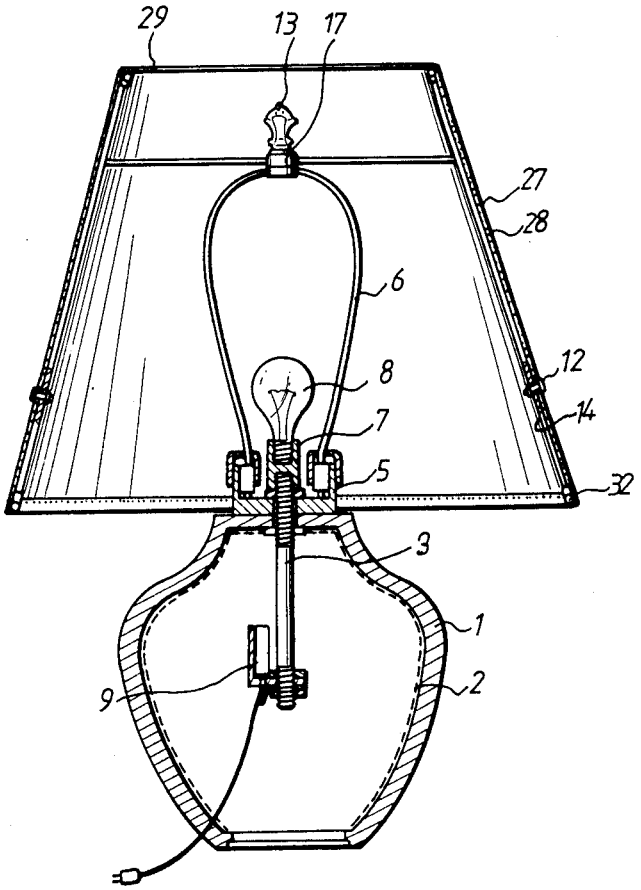
FIG. 3 is a sectional view of the present invention.
Figure 3A:
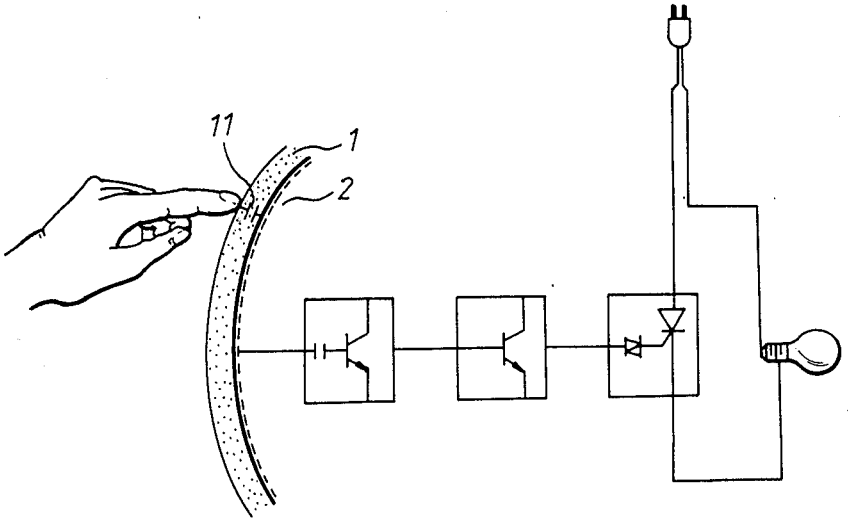
FIG. 3A is a block diagram of the present invention, showing the operation circuit of the present invention upon being contacted by a person.

Before assembling, the lamp shade according to the present invention can be reduced to a small unit as shown in FIG. 2B, which can be put together with the disassembled lamp shade frame into the available space in the packing container for the lamp stand 1 so as to save packing dimensions and shipping expense.

Briefly, the present invention is an improvement in lamp to have a non-metal lamp stand and the lamp shade become a body induction member in a lamp; further, the present invention can have the packing dimensions reduced, and have the shipping expense saved without sacrificing the practical use, and convenience of the present invention, and therefore it is deemed a novel disclosure.

I claim:

1. An improved body-electrostatic induction type of lamp device mainly comprising:

a non-metal lamp stand being mounted with a non-metal lamp shade, a lamp socket, a metal tube, a touch switch, a lamp, and a metal fixture; and said metal tube and said touch switch being mounted in the hollow cavity of said non-metal lamp stand by means of nuts; and said metal fixture mounted on said metal tube but on the top of said non-metal lamp stand being used for mounting a metal support frame; and on said metal support frame, said lamp shade being mounted; and both the non-metal portions of said lamp stand and said lamp shade having body-electrostatic induction function upon being contacted by a person.

2. A lamp devise as claimed in claim 1, wherein the lamp stand is a hollow member made of non-metal material such as ceramic, porcelain, wood, clay, plaster, stone, or plastics; and wherein said touch switch includes a portion of an operation circuit; and when said lamp stand or said lamp shade being contacted by a person, a signal being generated as a result of the body static charge, and then said signal being coupled into said touch switch.

3. A lamp device as claimed in claim 1, wherein the surface of said non-metal lamp shade includes a conductive fiber net being sewed or adhered thereon; and said conductive fiber net being electrically connected with said touch switch through a conductive means so as to obtain a contact induction effect.

4. A lamp device as claimed in claim 1, wherein said lamp shade includes a plurality of frame members being assembled into a frame on a detachable basis; and said frame mainly including an upper ring having three arc-shaped wires, a lower ring having three arc-shaped wires, three reverse L-shaped members, a ring fixture, and six T-shaped connectors, whereby said lamp shade can be assembled and disassembled so as to reduce the dimensions of said lamp shade when shipping or in storage.

* * * * *